United States Patent [19]

Thompson

[11] Patent Number: 5,026,340

[45] Date of Patent: Jun. 25, 1991

[54] FLAP CLOSER

[75] Inventor: Clyde W. Thompson, Tulsa, Okla.

[73] Assignee: Thompson Manufacturing Company, Inc., Tulsa, Okla.

[21] Appl. No.: 517,574

[22] Filed: May 1, 1990

[51] Int. Cl.[5] ..... B31B 1/48

[52] U.S. Cl. ..... 493/460; 493/245; 493/260; 271/2; 271/212

[58] Field of Search ..... 493/460, 461, 245, 260, 493/261, 453, 461; 271/212, 2

[56] References Cited

U.S. PATENT DOCUMENTS

| | | | |
|---|---|---|---|
| 3,212,774 | 10/1965 | Ingalls | 271/212 |
| 3,396,966 | 8/1968 | Solheim | 271/212 |
| 3,744,649 | 7/1973 | Ward, Jr. | 271/212 |
| 4,522,617 | 6/1985 | Mowry | 271/212 |
| 4,808,054 | 2/1989 | Cuzin | 271/212 |

*Primary Examiner*—Frederick R. Schmidt
*Assistant Examiner*—John Addison Marlott
*Attorney, Agent, or Firm*—Head & Johnson

[57] ABSTRACT

This disclosure provides an apparatus used in combination with an envelope feeder of the type having a frame with a generally horizontal feeder tray and a rack holding a stack of envelopes, the feeder having an endless belt supported on the feeder tray and the feeder serving to deliver envelopes from the stack onto the endless belt, the endless belt moving the envelopes to form a short-height stack at the outer end of the tray where the envelopes may be picked up by a printing press, a flap closure to close the envelope flaps so that open flaps do not interfere with the stacking process, the closure being in the form of an elongated member supported at the feeder tray outer end and having a first upper surface portion inclined upwardly in the direction away from the envelope feeder and a second horizontal upper surface spaced in a direction away from the envelope feeder, the second surface being in a plane parallel to and spaced above the plane of the endless belt.

5 Claims, 2 Drawing Sheets

FLAP CLOSER

SUMMARY OF THE INVENTION

Printing presses of the type particularly adaptable for printing or placing addresses on envelopes are commonly used. Most such printing presses require the envelopes to be delivered to the printing press in a short stack. The printing press removes the envelopes sequentially from the stack. For the printing press to work uninterrupted, a supply of envelopes forming the short stack is required.

An apparatus entitled "Envelope Feeder" has been commonly used for several years in the United States and other areas of the world. The envelope feeder is in essence a sheet feeder machine and usually is in the form of a sheet feeder machine with a special adapter to hold a large stack of envelopes to be fed by the machine to form a short continuously replaced stack adjacent the printing press.

For background information relating to feeders of the type to which the present disclosure pertains, reference should be had to U.S. Pat. No. 4,369,959 issued to William M. Hornbuckle on Jan. 25, 1983. Others have made improvements to the Hornbuckle machine, such as exemplified by U.S. Pat. No. 4,607,837 issued to Pierce on Aug. 26, 1986.

The envelope feeder of the type represented by U.S. Pats. Nos. 4,369,959 and 4,607,837 has a frame supported adjacent to a printing press. The frame includes a generally horizontal feeder tray having an outer end. Further, when used as an envelope feeder, the frame has a rack holding a relatively large stack of envelopes that are placed in the stack by the user by hand. The stack of envelopes may be periodically supplied by adding varying numbers of envelopes to the rack.

The feeder has an endless belt supported by the feeder tray and an outer roller adjacent the tray outer end. The endless belt moves around the outer roller, the belt moving in a generally horizontal plane. The feeder provides means for delivering envelopes from the manually placed stack onto the endless belt. The envelopes are transported in a sequential manner on the belt to form a short-height stack of envelopes past the outer roller. The short-height stack of envelopes is fed from the bottom so that the top envelope is freely available for being picked up by a printing press for printing or placement of a mailing address onto the envelope.

Envelopes typically have a top and a bottom and a pivotal flap on the bottom. A problem which exists with envelope feeders of the type described is that frequently the flap on the bottom of the envelope extends downwardly so that as the moving belt on the feeder tray moves an envelope to extend underneath the bottom most envelope in the short stack, the envelope is moved between the open flap and the next adjacent upper envelope. This causes problems in that the formation of the short-height stack of envelopes at the end of the envelope feeder is prevented, and in addition, with the flap extending under a next lower envelope, the envelopes cannot be easily picked up by the printing press.

The present device is directed toward an attachment for use with an envelope feeder to ensure that the flap is closed as an envelope is fed onto the bottom of a short height stack.

The apparatus of this invention is in the form of an elongated member supported adjacent the outer end of the envelope feeder tray having the endless belt thereon. The elongated member is parallel to and spaced from the envelope feeder outer roller.

The elongated member has a first upper surface inclined upwardly from the plane of the envelope feeder belt in the direction away from the outer roller. Further, the elongated member has a second generally horizontal upper surface contiguous to the inclined surface. The second horizontal surface is spaced in a direction away from the inclined surface and in a plane horizontal to and spaced above the plane of the envelope feeder endless belt.

As envelope are moved on the endless belt the forward edge thereof engages and rides up the first inclined surface and onto the second horizontal surface of the elongated member. The second horizontal surface serves to position the flap of each of the envelopes generally horizontally so that each succeeding envelope is positioned under the flap of the next adjacent forwardly advanced envelope.

The invention will be better understood with reference to the following description of the preferred embodiment and the claims, taken in conjunction with the attached drawings.

DESCRIPTION OF THE PREFERRED EMBODIMENT

Figure 1:
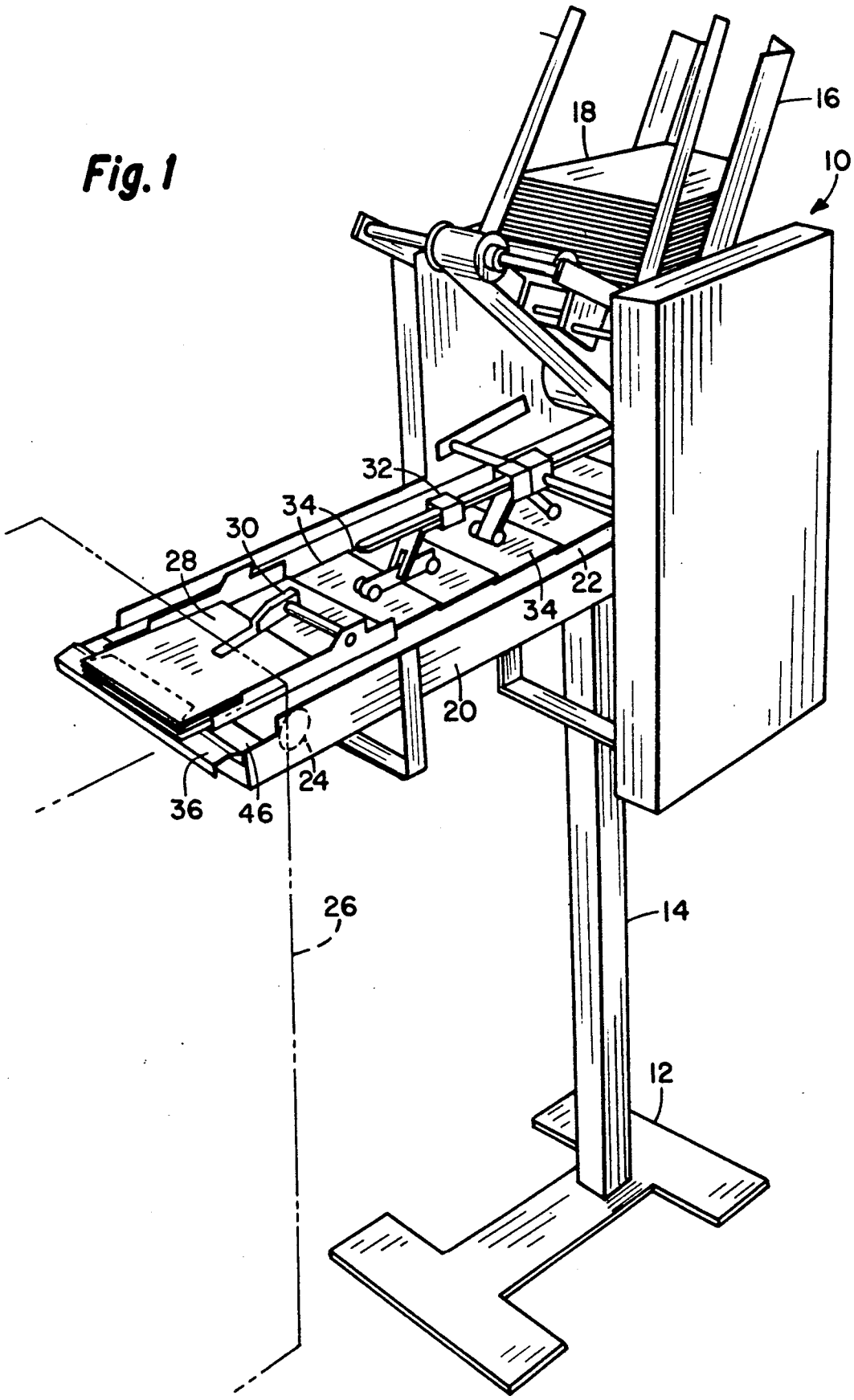
FIG. 1 is an isometric view of an envelope feeder in which envelopes to be fed to a printing press are manually placed in a stack, the envelope feeder having a generally horizontally extending feeding tray, the envelopes being moved on the horizontal tray and formed in a short-height stack adjacent to a printing press, as shown in dotted outline. Shown at the outer end of the horizontal tray is the envelope closer which forms the present invention.

Referring to the drawings and first to FIG. 1, an envelope feeder of the type for which this disclosure is used is illustrated in isometric. The envelope feeder is generally of the type described in detail in U.S. Pat. No. 4,369,959. This patent is entitled "Sheet Feed Machine" however, envelopes are fed by the machine in the same way. Generally the envelope feeder 10 is supported by a base 12 that rests on a floor surface and a stand 14. The feeder 10 has stack forming elements 16 that receive a stack of envelopes 18.

The feeder 10 has a generally horizontally extending feeder tray 20 having endless belts 22 thereon. The belt 22 moves around outer roller 24, as shown in dotted outline in FIG. 1.

The envelope feeder 10 is positioned adjacent a printing press, which is shown in dotted outline and identified by the numeral 26. The purpose of the envelope feeder 10 is to deliver envelopes from stack 18 sequentially and move the envelopes to form a short vertical stack 28 adjacent to printing press 26. The press 26 has a mechanism (not shown) for sequentially transferring the top envelope from the short stack 28 into the printing press for printing or placement of an address on the envelope. The short stack 28 must be continuously available for pick-up by the printing press, and the stack must be arranged in such a way that it is continuously fed from the bottom so that there is no interruption in the process of removing the top envelope from the stack for use by the printing press. The height of the short of envelopes 28 is regulated by a height sensor 30 which usually includes a micro-switch (not shown) that controls the operation of the envelope feeder 10, the method of such control not being shown since it is a standard feature of envelope feeders commercially on the market. In any event, feeder 10 includes control devices so that the height of the short vertical stack of envelopes 28 does not exceed a maximum limit. The feeder functions in a way so that an envelope is always present to be picked up by printing press 26.

Hold-down devices 32 are commonly used on the envelopes 34 as they are sequentially moved by endless belt 20 toward end roller 24 to be placed under short stack 28.

All of the mechanisms described to this point provide an environment in which the apparatus of this invention functions, that is, all of the elements 10–34 described are commonly, commercially employed. The apparatus of this invention is an attachment to envelope feeder 10 that improves the performance of the envelope delivering system.

Figure 2:
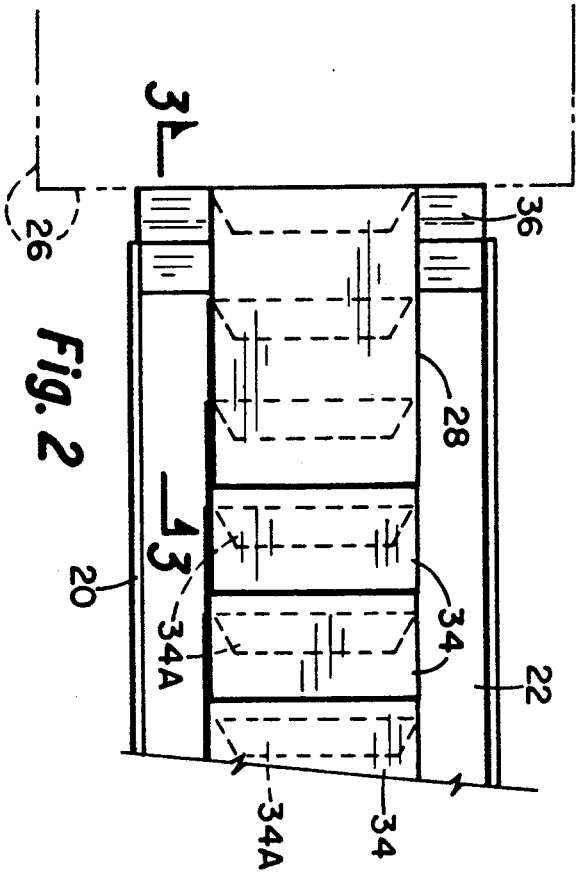
FIG. 2 is a partial top plan view of the outer end of the feeding tray showing envelopes moving on the endless belt on the feeding tray but without showing the hold-down devices that are illustrated in FIG. 1 and are customarily employed, the hold-down devices not being shown so as to better illustrate the relationship of the envelopes as they are fed by the feeder to be picked up by a printing press which is shown in phantom.

FIG. 2 is a top view showing a portion of feeder tray 20 having endless belt 22 thereon and showing envelopes 34 as they advance on the endless belt to sequentially move underneath the short vertical envelope stack 28. Each of the envelopes has a flap shown in dotted outline in FIG. 2, the flap being indicated by the numeral 34A. Since the envelopes are sequentially forwardly advanced on endless belt 22 there is a tendency for the forward end of the envelopes to extend underneath flaps 34A of the next adjacent envelope. When this happens the envelopes cannot properly vertically stack and removal of the envelopes by the printing press then becomes difficult.

For the operation of this invention, an envelope closer is employed. The envelope closer is in the form of an elongated member 36 affixed to the outer end of the feeder tray 20. The flap closer 36 is shown in FIGS. 1 and 2. The flap closer is shown in large cross-sectional view in FIG. 3. The flap closer 36 is an elongated member extending substantially the full width of envelope feeder tray 20 and has a first inclined upper surface 38 which is inclined upwardly and outwardly from the envelope feeder and in the direction toward printing press 26.

The flap closer 36 is further defined by an upper generally horizontal surface 40 which is contiguous to and connects with the inclined surface 38. In the illustrated arrangement of FIG. 3, flap closure 36 is further defined by a first generally vertical end surface 42 and a second or outer vertical end surface 44.

Figure 3:
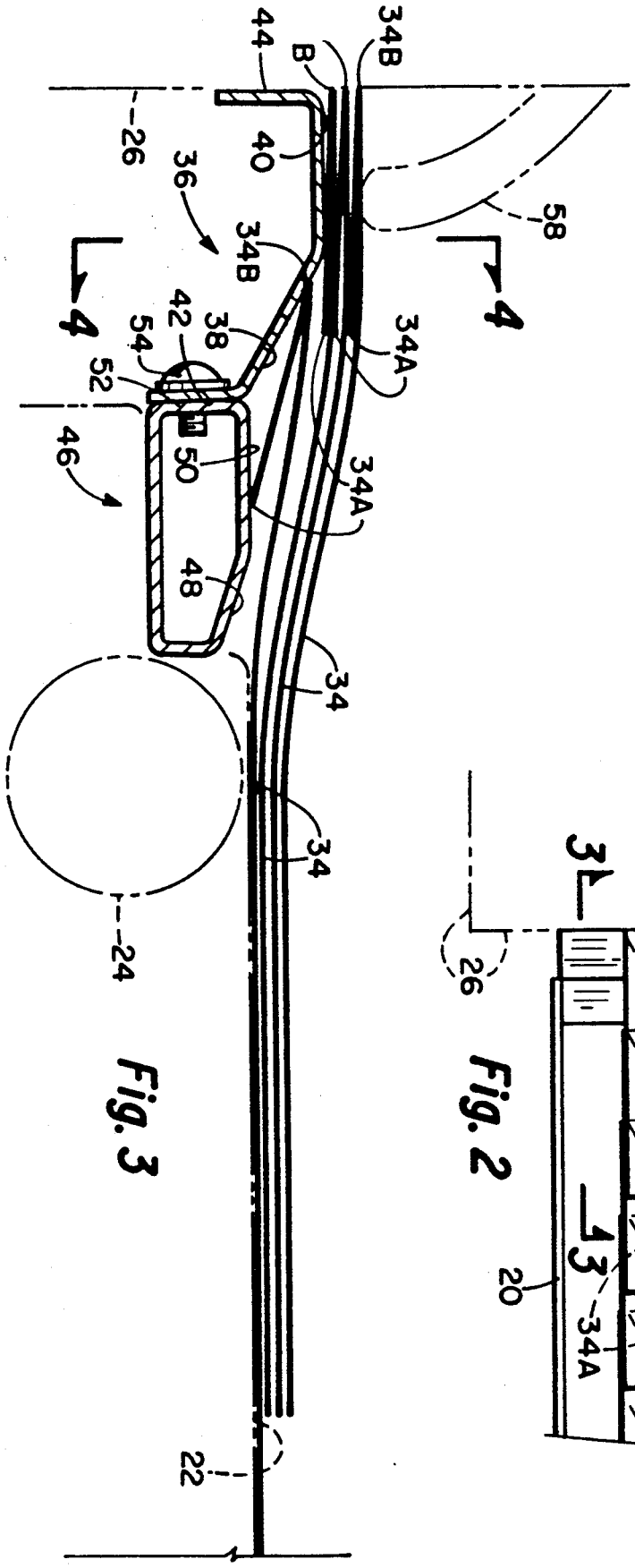
FIG. 3 is an enlarged partial cross-sectional elevational view taken along the line 3—3 of FIG. 2 showing the outer end of the envelope feeder tray with the envelope closer of this disclosure attached thereto and showing envelopes moved by the endless belt on the tray as the envelopes accumulate at the outer end of the tray to form a short stack adjacent to a printing press.

The flap closure 36 is preferably formed of thin, stiff sheet steel or aluminum plate bent in the cross-sectional configuration as shown in FIG. 3 to provide surfaces 38, 40 42 and 44.

The flap closure 36 may be affixed directly to the outer end of envelope feeder tray 20. A preferred method of doing this is by the use of a mounting bar, generally indicated by the numeral 46. The mounting bar is affixed to the outer end of the envelope feeder tray 20, and the flap closure 36 is secured to the mounting bar. As shown in the cross-sectional view of FIG. 3 the mounting bar is, in the embodiment illustrated in the form of an elongate tube having an upper inclined surface 48 and a horizontal surface 50. Instead of being formed as a tube, the bar can be solid with the inclined surface 48 and horizontal surface 50.

Figure 4:
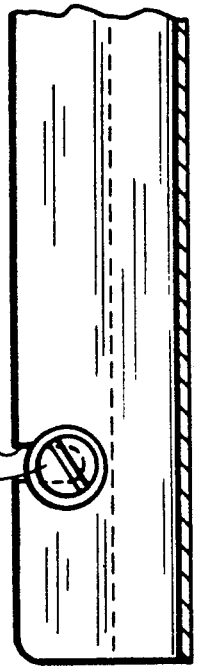
FIG. 4 is a fragmentary cross-sectional view taken along the line 4—4 of FIG. 3 but without showing envelopes thereon. The purpose of FIG. 4 is to show the height adjustment features of the envelope closer.

The mounting bar 46 has an outer end wall 52 that receives spaced apart bolts 54, only one bolt being shown in FIGS. 3 and 4. The bolts 54 serve as means of securing flap closure 36 to the mounting bar. As shown in FIG. 4, the flap closure has, in the portion providing first vertical end surface 42, elongated slots 56 that receive bolts 54. By the use of such elongated slots, elevational position of flap closure 36 with respect to mounting bar 46 can be adjusted.

As seen in FIG. 3, as envelopes 34 advance the flaps 34A extend downwardly. The forward edge 34B of each of the envelopes is moved by the envelope stacker endless belt toward the printing press 26. As the forward edge engages the flap closure inclined surface 38, the forward edge is guide up under the next above adjacent envelope 34 in the stack. The envelopes rest with the flaps 34A on the closure upper horizontal surface 40, which tends to move the flaps into parallel relationship with the envelopes themselves or at least the portions of the envelopes having the flaps extending therefrom. The typical printing press includes a flexible hold-down device 58, as shown diagrammatically in FIG. 3. This hold-down device 58 retrains the envelope stack in the direction toward the closer upper horizontal surface 40 so as to keep the envelope flaps 34A parallel to the envelopes.

It can be seen that with the envelope flap closer 36 attached to an envelope feeder of the type shown in FIG. 1, the possibility of malfunction is reduced as the envelopes are guided in such a way the flaps of the envelopes in the short stack remain closed so as not to engage or interfere with the next envelope moving underneath the short stack.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. In combination with an envelope feeder of the type having a frame supporting a generally horizontal feeder tray having an outer end, and a rack holding a stack of envelopes, the feeder having an endless belt supported by the feeder tray and having an outer roll adjacent the tray outer end, around which the belt passes, the belt moving in a generally horizontal plane and provisions for delivering envelopes from the stack onto the endless belt, the envelopes being transported in sequential manner on the belt to form a short-height stack of envelopes past the outer roller, the short-height stack being useable by a printing press, the envelopes each having a top and a bottom and a pivotal flap on the bottom, a flap closer comprising:

an elongated stationary member suppported adjacent the feeder tray outer end, the member being parallel and spaced from the outer roller, the member having a first upper surface portion inclined upwardly from the plane of the belt in the direction away from the outher roller and a second, generally horizontal upper surface contiguous to the first and spaced in the direction away from the surface, the second upper surface being in a generally horizontal plane parallel to and spaced above the plane of the endless belt, the envelopes engaging and riding up the first surface and onto the second surface as the envelopes are moved by the endless belt, the second surface serving to position the flap of each envelope generally horizontally so that each succeeding envelope is positioned under the flap of the next adjacent forwardly advanced envelope.

2. A flap closer for use with an envelope feeder according to claim 1 including:

means for elevationally adjustably position the flap closer with respect to the plane of the endless belt.

3. A flap closer for use with an envelope feeder according to claim 1 including:

a mounting bar supported to the envelope feed tray at the outer end thereof past the outer roller and parallel to and spaced from the roller, the mounting bar having a rearward end portion adjacent to and parallel the outer roller, an upper surface and a generally vertical outer end portion parallel to and spaced from the inner end portion, said flap closer having a forward surface affixed to the mounting bar outer end portion.

4. A flap closer for an envelope feeder according to claim 3 including:

spaced apart bolts extending generally horizontally from said mounting bar outer end portion and wherein said flap closer member has a generally vertical, downwardly extending forward end portion having spaced apart vertical slots therein receiving said bolts, the slots and bolts providing means of vertically adjusting said flap closer relative to the plane of said endless belt.

5. A flap closer according to claim 3 wherein said mounting bar upper surface is defined in part by a surface inclined upwardly in the direction towards said flap closer.

* * * * *